US006368180B1

(12) United States Patent
Dailey

(10) Patent No.: US 6,368,180 B1
(45) Date of Patent: Apr. 9, 2002

(54) SYSTEM FOR REPAIRING A BRASSIERE

(76) Inventor: Sandra Dailey, 14742 Maplewood Ave., Harvey, IL (US) 60426

( * ) Notice: Subject to any disclaimer, the term of this patent is extended or adjusted under 35 U.S.C. 154(b) by 0 days.

(21) Appl. No.: 09/770,442

(22) Filed: Jan. 26, 2001

(51) Int. Cl.[7] ..... A41C 3/00; A41C 3/12

(52) U.S. Cl. ..... 450/86; 450/88; 2/336; 2/300

(58) Field of Search ..... 450/1, 28, 86, 450/88; 2/310, 321, 322, 333, 336; 24/198, 200

(56) References Cited

U.S. PATENT DOCUMENTS 2,095,340 A * 10/1937 Meyers ..... 24/198
2,529,308 A * 11/1950 Powers ..... 24/73
2,843,905 A * 7/1958 Brubaker ..... 24/200
6,056,626 A * 5/2000 Fidan ..... 450/86
6,059,634 A * 5/2000 Fidan ..... 450/86
6,155,906 A * 12/2000 May ..... 450/88
6,186,861 B1 * 2/2001 Flaherty ..... 450/1

* cited by examiner

*Primary Examiner*—John J. Calvert
*Assistant Examiner*—Alissa L. Hoey

(57) ABSTRACT

A system for repairing a brassiere for replacing broken brassiere buckles and attachment rings. The system includes a connector member for removably coupling the shoulder strap to the front portion of the brassiere. The connector member defines an interior for removably receiving a portion of the shoulder strap and a portion of the front portion. The connector member includes a base portion having a base side adjacent the interior of the connector member, and a pair of arm portions extending from the base section such that the interior of the connector member is defined by the base portion and the pair of arm portions. The connector member also includes a pair of constrictor portions, each of the constrictor portions being mounted on one of the arm portions. The constrictor portions extend generally toward each other. Each of the constrictor portions has opposite ends, with one of the ends of each of the constrictor portions forming a constricted gap therebetween.

16 Claims, 3 Drawing Sheets

SYSTEM FOR REPAIRING A BRASSIERE

BACKGROUND OF THE INVENTION

1. Field of the Invention

The present invention relates to brassieres and more particularly pertains to a new system for repairing a brassiere to replace broken or missing brassiere buckles and attachment rings.

2. Description of the Prior Art

The repair of brassiere is known in the prior art. One example of systems developed for the repair of brassieres is disclosed in my U.S. Pat. No. 5,911,618, entitled "DETACHABLE BRASSIERE STRAP BUCKLE AND ATTACHMENT RING". The system disclosed in my prior patent employed a detachable strap buckle and an attachment ring for repairing a brassiere. While this system is highly effective for repairing brassieres, improvements in the system have been developed for increasing ease of installing the components on the brassiere.

SUMMARY OF THE INVENTION

The present invention provides a new system for repairing a brassiere construction wherein the same can be utilized for replacing broken or missing brassiere buckles and attachment rings.

To attain this, the present invention generally comprises a connector member for removably coupling the shoulder strap to the front portion of the brassiere. The connector member defines an interior for removably receiving a portion of the shoulder strap and a portion of the front portion. The connector member includes a base portion having a base side adjacent the interior of the connector member, and a pair of arm portions extending from the base section such that the interior of the connector member is defined by the base portion and the pair of arm portions. The connector member also includes a pair of constrictor portions, each of the constrictor portions being mounted on one of the arm portions. The constrictor portions extend generally toward each other. Each of the constrictor portions has opposite ends, with one of the ends of each of the constrictor portions forming a constricted gap therebetween.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new system for repairing a brassiere apparatus and method which has many of the advantages of the brassieres mentioned heretofore and many novel features that result in a new system for repairing a brassiere which is not anticipated, rendered obvious, suggested, or even implied by any of the prior art brassieres, either alone or in any combination thereof.

It is another object of the present invention to provide a new system for repairing a brassiere which may be easily and efficiently manufactured and marketed.

It is a further object of the present invention to provide a new system for repairing a brassiere which is of a durable and reliable construction.

An even further object of the present invention is to provide a new system for repairing a brassiere which is susceptible of a low cost of manufacture with regard to both materials and labor, and which accordingly is then susceptible of low prices of sale to the consuming public, thereby making such system for repairing a brassiere economically available to the buying public.

Still yet another object of the present invention is to provide a new system for repairing a brassiere which provides in the apparatuses and methods of the prior art some of the advantages thereof, while simultaneously overcoming some of the disadvantages normally associated therewith.

Still another object of the present invention is to provide a new system for repairing a brassiere for replacing broken or missing brassiere buckles and attachment rings.

Yet another object of the present invention is to provide a new system for repairing a brassiere which includes a connector member for removably coupling the shoulder strap to the front portion of the brassiere. The connector member defines an interior for removably receiving a portion of the shoulder strap and a portion of the front portion. The connector member includes a base portion having a base side adjacent the interior of the connector member, and a pair of arm portions extending from the base section such that the interior of the connector member is defined by the base portion and the pair of arm portions. The connector member also includes a pair of constrictor portions, each of the constrictor portions being mounted on one of the arm portions. The constrictor portions extend generally toward each other. Each of the constrictor portions has opposite ends, with one of the ends of each of the constrictor portions forming a constricted gap therebetween.

Still yet another object of the present invention is to provide a new system for repairing a brassiere that allows a convenient means for repairing broken adjustment buckles and attachment rings on a brassiere.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
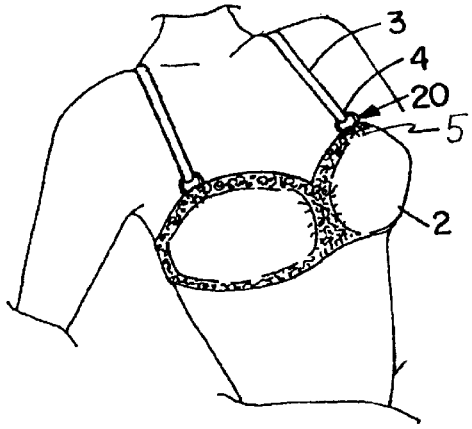
FIG. 1 is a perspective view of a brassiere with a removable connector member of the invention shown mounted thereon.
Figure 2:
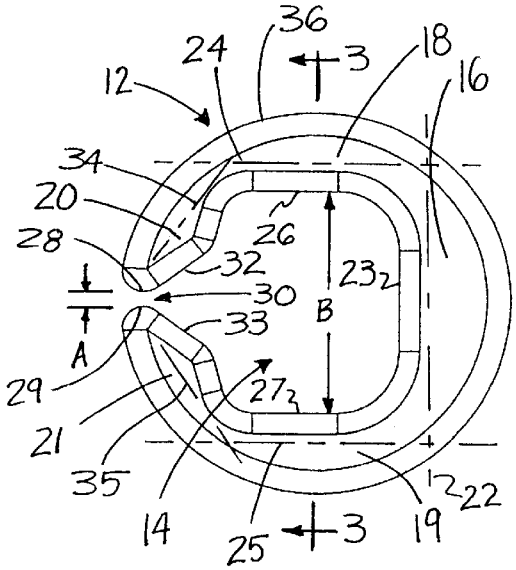
FIG. 2 is a side view of the connector member of the invention.
Figure 3:
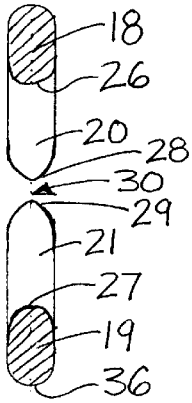
FIG. 3 is a sectional view of the connector member taken along line 3—3 of FIG. 2.
Figure 4:
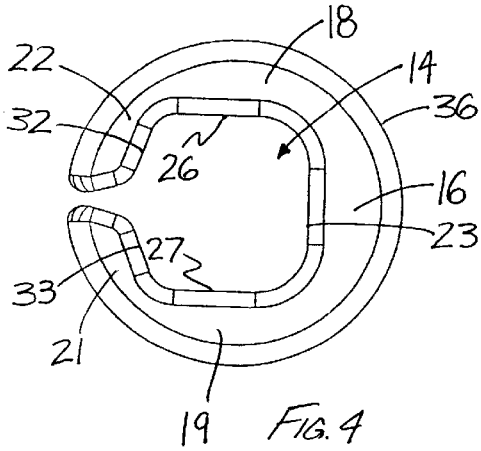
FIG. 4 is a side view of a connector member of the invention having an optional configuration.
Figure 9:
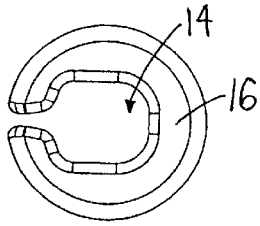
FIG. 9 is a side view of a connector member of the invention having an optional configuration.

With reference now to the drawings, and in particular to FIGS. 1 through 9 thereof, a new system for system for repairing a brassiere embodying the principles and concepts of the present invention will be described.

As best illustrated in FIGS. 1 through 9, the system 10 of a detachable brassiere strap buckle and a connector member is designed to replace broken parts of a brassiere 2 and includes the replaceable connector member 12 and the replaceable buckle member 40. These elements, along with the shoulder strap 3, help adjustably secure the shoulder strap 3 to the brassiere 2 for supporting the brassiere on the torso of the wearer.

The connector member 12 removably couples the shoulder strap 3 to the front portion 5 of the brassiere. The connector member 12 defines an interior 14 with a portion of the shoulder strap and a portion of the front portion removably mounted therein. The connector member comprises a base portion 16, a pair of arm portions 18, 19, and a pair of constrictor portions 20, 21.

The base portion 16 has opposite ends with a base axis 22 extending between the ends. The base portion has a base side 23 adjacent the interior of the connector member 12.

The pair 18, 19 of arm portions extend from the base portion, and the interior 14 of the connector member is defined by the base portion and the pair of arm portions. Each of the arm portions has opposite ends, and each of the arm portions has an arm axis 24, 25 extending between the ends of the respective arm portion. The arm axis 24, 25 of each of the arm portions may extend substantially perpendicular to the base axis 22 of the base portion 16. The arm portions 18, 19 are spaced from each other, and preferably (although not necessarily) the arm axes 24, 25 of the arm portions may be oriented substantially parallel to each other. Each of the arm portions 18, 19 has an arm side 26, 27 located adjacent to the interior of the connector member. The arm sides 26, 27 of the arm portions may be oriented substantially parallel to each other, and the arm sides may be oriented substantially perpendicular to the base side of the base portion.

Each of the pair of constrictor portions 20, 21 is mounted on one of the arm portions 18, 19. The constrictor portions extend generally toward each other in a converging manner. Each of the constrictor portions has opposite ends, with one 28, 29 of the ends of each of the constrictor portions forming a constricted gap 30 between the ends 28, 29. The constricted gap 30 defines a first width (A) and a second width (B) is defined between arm sides of the arm portions. Preferably, the first width is between approximately 5 and approximately 15 percent of the second width. Most preferably, the first width is between approximately 5 and approximately 10 percent of the second width. Each of the constrictor portions has a constricting side 32, 33 located adjacent to the interior of the connector member and the constricted gap. The constricting side 32 of one of the constrictor portions is oriented at an angle with respect to the constricting side of the other of the constrictor portions 33. The angle is preferably between approximately 30 degrees and 80 degrees. In one embodiment of the invention, the angle is approximately 35 degrees. In another embodiment of the invention, the angle is approximately 75 degrees. Each of the constrictor portions has a constrictor axis 34, 35 extending between the ends of the constrictor portion, and each of the constrictor axes is oriented at an angle with respect to one of the arm axes 24, 25.

The connector member 12 has an exterior edge 36, with a break in the edge corresponding to the constricted gap 30. The exterior edge may be substantially circular in shape. The sides of the connector member forming the interior are preferably rounded or beveled in profile.

In one illustrative embodiment (see FIG. 2) of the connector member of the invention, the exterior edge of the connector member is circular with a diameter of approximately 20 millimeters (mm), and has a thickness of approximately 2 to 3 mm. The constricted gap has a width of approximately 0.75 mm.

In a second illustrative embodiment (see FIG. 4) of the connector member of the invention, the exterior edge of the connector member is circular with a diameter of approximately 16 mm, and has a thickness of approximately 2 mm. The constricted gap has a width of approximately 0.6 mm. The distance between the arm sides is approximately 9 mm.

In a third illustrative embodiment (see FIG. 9) of the connector member of the invention, the exterior edge of the connector member is circular with a diameter of approximately 10 mm, and has a thickness of approximately 1.5 mm. The constricted gap has a width of approximately 0.6 mm. It will be noted that the angle between the constricting sides may be reduced to approximately 20 degrees such that a throat is formed between the constrictor sides.

Figure 5:
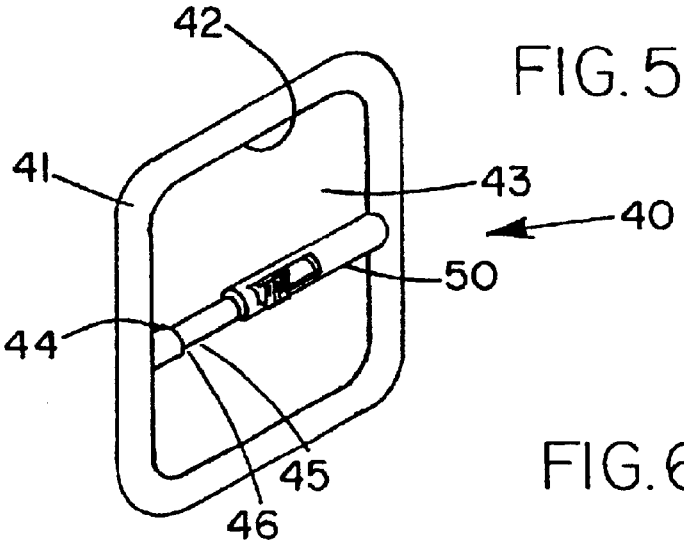
FIG. 5 is a perspective view of a detachable adjustable strap buckle of the present invention.

The buckle member 40 of the invention has a frame 41 with an inner periphery 42 defining an inner opening 43. The buckle member 40 also has a prong 44 that extends from one portion of the inner periphery 42 of the frame 41 toward an other portion of the inner periphery 42 of the frame 41 as shown in FIG. 5. The prong 50 is also biased toward the other portion of the inner periphery 42.

Figure 6:
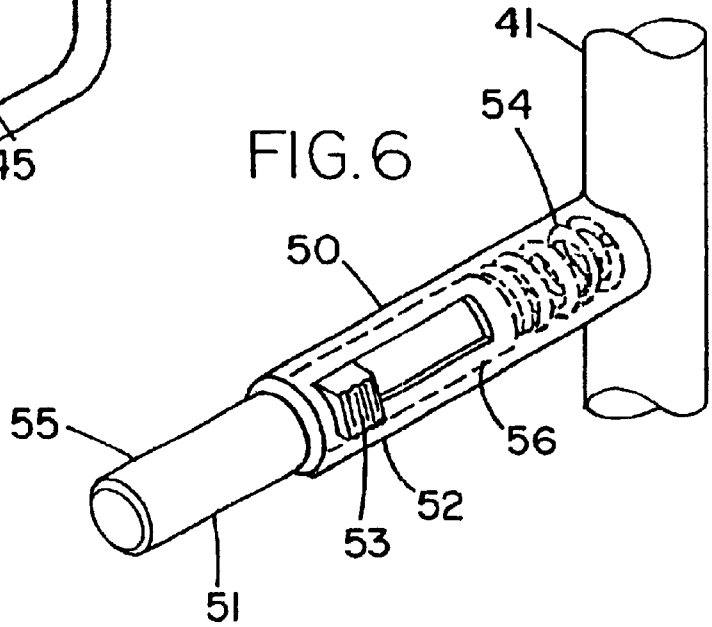
FIG. 6 is a partial perspective view of the adjustable strap buckle embodiment detailing the prong.

Preferably, the prong 50 includes a tongue portion 51 and a tube portion 52. The tube portion 52 extends from the inner periphery 42. The tongue portion 51 is slidably mounted to the tube portion 52. Ideally, the tongue portion 51 is slidably mounted to the tube portion 52 by insertion of the tongue bottom end 34 into the lumen of the tube portion 52. Preferably, the tongue 30 is biased toward the other portion of the inner periphery 42 by a biasing means 32 such as spring. Ideally, the tongue 30 is biased by a spring 32 provided within the lumen of the tube portion 52 as shown in FIG. 6.

Preferably, a knob 53 extends from the tongue portion 51 to aid in sliding the tongue portion 51 away from the rest 44. Ideally, the rest 44 has a rest bore 46 allowing the top end 55 of the tongue portion 51 to be inserted therein to help securely close the gap 45.

Preferably, as shown in FIG. 5, a rest 44 extends from the other portion of the inner periphery 42 so that when the top end 55 of the tongue portion 51 is slid towards the other portion, it may be abutted against the rest 44. Ideally, the rest 44 has a rest bore 46 allowing the top end 55 to be inserted therein to help secure the prong 50 when the prong 55 is extended toward the rest 44.

Figure 8:
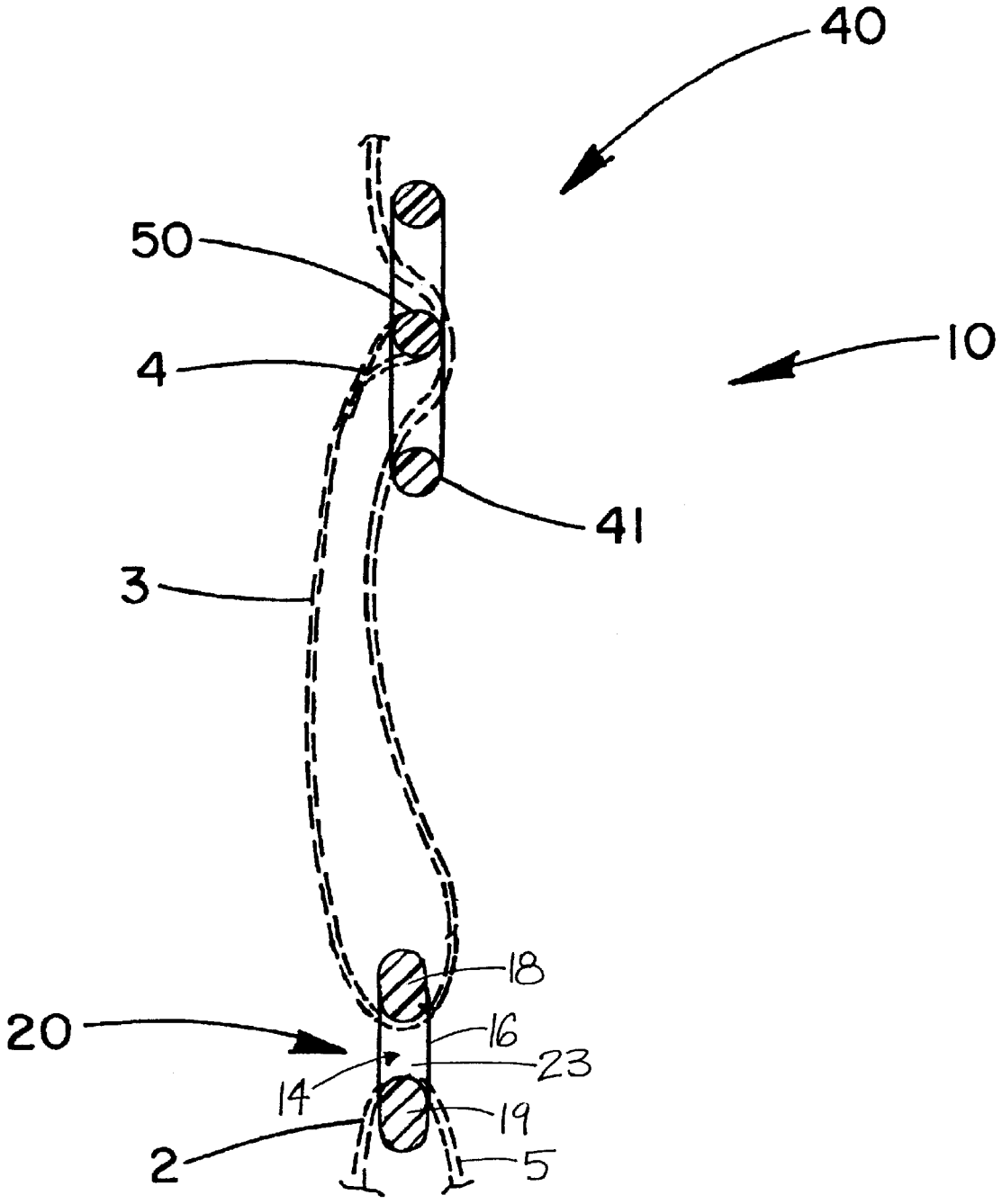
FIG. 8 is a side view of the shoulder strap attached to the buckle member and looped through the connector member.

In use, the connector member 20 is designed to replace a broken ring of the brassiere 2 as shown in FIG. 1. Illustratively, when using the connector member to repair a broken ring, the first step is to slide one of the arm portions of the connector member through a loop formed by the shoulder strap as shown in FIG. 8. The other of the arm portions is inserted through a loop of the front portion 5 of the brassiere.

Figure 7:
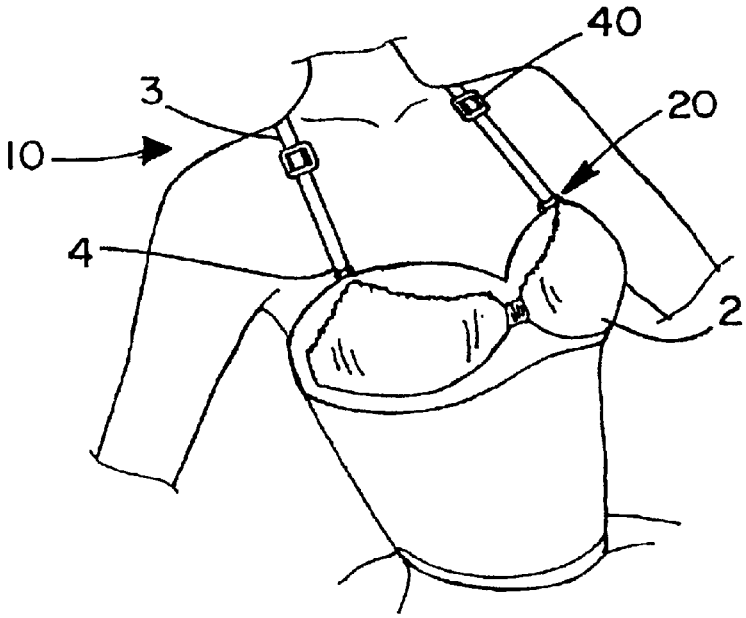
FIG. 7 is a perspective view of a brassiere with the detachable connector member and the adjustable strap buckle of the invention.

In use, the buckle member 40 is designed to replace a buckle member of the brassiere 2 as shown in FIG. 7. Typically, the shoulder strap 3 is looped through the connector member 20 and the looped end 4 is attached to the buckle member 40. Illustratively, the shoulder strap is first woven around the prong 50 as shown in FIG. 8. The shoulder strap looped end 4 is inserted through the inner opening 27 so that the shoulder strap 3 is looped around the ring member 20. The shoulder strap looped end 4 is attached to the buckle member 40 by first sliding the tongue portion top end 55 away from the rest 44 towards the tube portion 52 to form a gap 45 between the tongue portion 51 and the rest 44. The knob 53 may be used to help slide the tongue portion top end 55 between the rest 44 and the tube portion 52.

The shoulder strap looped end 4 is then inserted through the gap 45. The tongue portion 51 is slid towards the rest 44 so that the shoulder strap looped end 4 is looped around the tongue portion 51. The tongue portion 51 is slid towards the rest 44 until the tongue portion top end 55 abuts against the rest 44 to secure the shoulder strap 3 to the brassiere 2. Ideally, the tongue portion top end 55 is also inserted into the rest bore 46 to further secure the shoulder strap 3 to the brassiere 2.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A system for replacing an attachment ring on a brassiere having a front portion and a shoulder strap for supporting the front portion of the brassiere on a torso of a wearer, the system comprising:

a connector member for removably coupling the shoulder strap to the front portion of the brassiere, the connector member having an exterior edge and defining an interior for removably receiving a portion of the shoulder strap and a portion of the front portion, the connector member comprising:

a base portion having a base side adjacent the interior of the connector member;

a pair of arm portions extending from the base section, the interior of the connector member being defined by the base portion and the pair of arm portions; and a pair of constrictor portions, each of the constrictor portions being mounted on one of the arm portions, the constrictor portions extending generally toward each other, each of the constrictor portions having opposite ends, one of the ends of each of the constrictor portions forming a constricted gap therebetween;

wherein each of the constrictor portions has a constricting side adjacent the interior of the connector member and the constricted gap, the constricting sides converging toward the exterior edge and diverging toward the interior of the connector member such that a width of the constricted gap tapers narrower toward the exterior edge for facilitating removal of the shoulder strap from the interior of the connector member when desired.

2. The system of claim 1 wherein the base portion has opposite ends with a base axis extending between the ends, each of the arm portions having opposite ends with an arm axis extending between the ends of the arm portion, and each of the constrictor portions having opposite ends with a constrictor axis extending between the ends of the constrictor portion.

3. The system of claim 2 wherein the arm axis of each of the arm portions extends substantially perpendicular to the base axis of the base portion.

4. The system of claim 2 wherein the arm portions are spaced from each other, the arm axes of the arm portions being oriented substantially parallel to each other.

5. The system of claim 2 wherein the constricted gap defines a first width and a second width is defined between arm sides of the arm portions.

6. The system of claim 5 wherein the first width is between approximately 5 and approximately 15 percent of the second width.

7. The system of claim 5 wherein the first width is between approximately 5 and approximately 10 percent of the second width.

8. The system of claim 1 wherein each of the arm portions has an arm side adjacent the interior of the connector member, the arm sides of the arm portions being oriented substantially parallel to each other.

9. The system of claim 8 wherein the arm sides are oriented substantially perpendicular to the base side of the base portion.

10. The system of claim 1 wherein the constricting side of one of the constrictor portions is oriented at an angle with respect to the constricting side of the other of the constrictor portions, the angle between the constrictor sides of the constrictor portions measuring between approximately 30 degrees and 80 degrees.

11. The system of claim 1 wherein the angle is approximately 35 degrees.

12. The system of claim 1 wherein the angle is approximately 75 degrees.

13. The system of claim 1 wherein the exterior edge is substantially circular, the exterior edge having a break corresponding to the constricted gap.

14. The system of claim 1 additionally comprising a buckle member comprising:

a frame having an inner periphery defining an interior opening;

a rest being extended from the inner periphery; and a prong having a tongue portion and a tube portion, the tube portion being extended from a portion of the frame inner periphery, the tongue portion being slidably mounted to the tube portion, the tongue portion being extended towards the rest, the tongue portion being biased towards the rest.

15. A method for replacing an attachment ring on a brassiere having a front portion and a shoulder strap for supporting the front portion of the brassiere on a torso of a wearer, the method comprising: providing a brassiere having a front portion and a shoulder strap for supporting the front portion of the brassiere on a torso of a wearer; providing a connector member for removably coupling the shoulder strap to the front portion of the brassiere, the connector member having an exterior edge and defining an interior with a portion of the shoulder strap and a portion of the front portion removably mounted therein, the connector member comprising:

a base portion having a base side adjacent the interior of the connector member;

a pair of arm portions extending from the base section, the interior of the connector member being defined by the base portion and the pair of arm portions; and a pair of constrictor portions, each of the constrictor portions being mounted on one of the arm portions, the constrictor portions extending generally toward each other, each of the constrictor portions having opposite ends, one of the ends of each of the constrictor portions forming a constricted gap therebetween;

wherein each of the constrictor portions has a constricting side adjacent the interior of the connector member and the constricted gap, the constricting sides converging toward the exterior edge and diverging toward the interior of the connector member such that a width of the constricted gap tapers narrower toward the exterior edge for facilitating removal of the shoulder strap from the interior of the connector member when desired;

providing a buckle member, the buckle member including:

a frame having an inner periphery defining an interior opening;

a rest being extended from the inner periphery;

a prong having a tongue portion and a tube portion, the tube portion being extended from a portion of the frame inner periphery, the tongue portion being slidably mounted to the tube portion, the tongue portion being extended towards the rest, the tongue portion being biased towards the rest;

sliding the tongue portion away from the rest;

inserting the shoulder strap through the gap between the prong tongue portion and the rest;

sliding the tongue portion towards the rest;

looping the shoulder strap around the prong;

inserting a first one of the arm portions of the connector member through a loop formed by a portion of the shoulder strap; and inserting a second one of the arm portions of the connector member through a loop on the front portion of the brassiere.

16. An article of apparel comprising:

a brassiere having a front portion and a shoulder strap for supporting the front portion of the brassiere on a torso of a wearer;

a connector member removably coupling the shoulder strap to the front portion of the brassiere, the connector member defining an interior with a portion of the shoulder strap and a portion of the front portion removably mounted therein, the connector member comprising:

a base portion, the base portion having opposite ends with a base axis extending between the ends, the base portion having a base side adjacent the interior of the connector member;

a pair of arm portions extending from the base section, the interior of the connector member being defined by the base portion and the pair of arm portions, each of the arm portions having opposite ends;

wherein each of the arm portions has an arm axis extending between the ends of the arm portion, the arm axis of each of the arm portions extending substantially perpendicular to the base axis of the base portion;

wherein the arm portions are spaced from each other, the arm axes of the arm portions being oriented substantially parallel to each other;

wherein each of the arm portions has an arm side adjacent the interior of the connector member, the arm sides of the arm portions being oriented substantially parallel to each other, the arm sides being oriented substantially perpendicular to the base side of the base portion;

a pair of constrictor portions, each of the constrictor portions being mounted on one of the arm portions, the constrictor portions extending generally toward each other, each of the constrictor portions having opposite ends, one of the ends of each of the constrictor portions forming a constricted gap therebetween;

wherein the constricted gap defines a first width and a second width is defined between arm sides of the arm portions;

wherein each of the constrictor portions has a constricting side adjacent the interior of the connector member and the constricted gap, the constricting side of one of the constrictor portions being oriented at an angle with respect to the constricting side of the other of the constrictor portions;

wherein each of the constrictor portions has a constricting side adjacent the interior of the connector member and the constricted gap, the constricting sides converging toward the exterior edge and diverging toward the interior of the connector member such that a width of the constricted gap tapers narrower toward the exterior edge for facilitating removal of the shoulder strap from the interior of the connector member when desired;

wherein each of the constrictor portions has a constrictor axis extending between the ends of the constrictor portion, each of the constrictor axes being oriented at an angle with respect to one of the arm axes;

wherein the connector member has an exterior edge, the exterior edge being substantially circular, the exterior edge having a break corresponding to the constricted gap.

* * * * *